US010537932B2

(12) United States Patent
Moser et al.

(10) Patent No.: US 10,537,932 B2
(45) Date of Patent: Jan. 21, 2020

(54) TRANSPORT METHOD FOR TRANSFERRING WORKPIECES

(71) Applicant: Hatebur Umformmaschinen AG, Reinach (CH)

(72) Inventors: Markus Moser, Arlesheim (CH); Stephan Leibundgut, Reinach (CH); Andreas Maritz, Dornach (CH); Andreas Matt, Murg (DE)

(73) Assignee: Hatebur Umformmaschinen AG, Reinach (CH)

( * ) Notice: Subject to any disclaimer, the term of this patent is extended or adjusted under 35 U.S.C. 154(b) by 0 days.

(21) Appl. No.: 16/096,752

(22) PCT Filed: Apr. 25, 2017

(86) PCT No.: PCT/EP2017/059724

§ 371 (c)(1),
(2) Date: Oct. 26, 2018

(87) PCT Pub. No.: WO2017/186675

PCT Pub. Date: Nov. 2, 2017

(65) Prior Publication Data

US 2019/0118241 A1 Apr. 25, 2019

(30) Foreign Application Priority Data

Apr. 28, 2016 (CH) ..... 0562/16

(51) Int. Cl.
*B65G 47/74* (2006.01)
*B65G 47/90* (2006.01)
(Continued)

(52) U.S. Cl.
CPC ..... *B21D 43/025* (2013.01); *B21D 43/05* (2013.01); *B21D 43/10* (2013.01); *B21K 27/04* (2013.01)

(58) Field of Classification Search
None
See application file for complete search history.

(56) References Cited

U.S. PATENT DOCUMENTS 2,791,786 A 5/1957 Hoyt et al.
3,994,403 A 11/1976 Steinhauser
(Continued)

FOREIGN PATENT DOCUMENTS

CH 595155 A5 1/1978
CN 203437581 U 2/2014
(Continued)

*Primary Examiner* — Kavel Singh
(74) *Attorney, Agent, or Firm* — The Webb Law Firm

(57) ABSTRACT

In a transport method for transferring workpieces between a plurality of successive stations of a processing device, especially a forming device, workpieces are in each case transported from one station to the respective next station of the processing device simultaneously by means of a plurality of gripping tools which are movable jointly in a transport cycle. In the event of a process disturbance, the transport cycle is suspended and the gripping tools with the workpieces are moved into a waiting position in which the workpieces are outside the operating range of processing tools of the stations of the processing device. Once the process disturbance has been eliminated, the transport cycle of the workpieces is resumed. By virtue of the movement of the gripping tools into a safe waiting position outside the operating range of the processing tools of the stations, consequent damage resulting from the process disturbance can be prevented.

20 Claims, 13 Drawing Sheets

(51) Int. Cl.

| | |
|---|---|
| ***B21D 43/00*** | (2006.01) |
| ***B21K 27/04*** | (2006.01) |
| ***B21D 43/02*** | (2006.01) |
| ***B21D 43/05*** | (2006.01) |
| ***B21D 43/10*** | (2006.01) |

(56) References Cited

U.S. PATENT DOCUMENTS

| | | | | |
|---|---|---|---|---|
| 4,473,147 | A * | 9/1984 | Bouwman | B23Q 7/04 198/750.5 |
| 4,676,540 | A | 6/1987 | Dotti et al. | |
| 4,715,773 | A | 12/1987 | Parker et al. | |
| 5,190,138 | A * | 3/1993 | Strasser | B65B 1/34 198/468.8 |
| 5,713,236 | A | 2/1998 | Genet et al. | |
| 5,775,163 | A | 7/1998 | Riedisser | |
| 6,272,892 | B1 * | 8/2001 | Ozaki | B21J 9/20 72/21.3 |
| 6,371,544 | B1 | 4/2002 | Wang | |
| 6,435,336 | B1 | 8/2002 | Knodler | |
| 6,715,981 | B1 | 4/2004 | Harsch et al. | |
| 7,574,887 | B2 | 8/2009 | Suter et al. | |
| 7,690,706 | B2 | 4/2010 | Wild et al. | |
| 2007/0261524 | A1 | 11/2007 | Suter et al. | |

FOREIGN PATENT DOCUMENTS

| | | | |
|---|---|---|---|
| CN | 203917775 | U | 11/2014 |
| DE | 1069993 | B | 11/1959 |
| EP | 0184079 | A2 | 6/1986 |
| EP | 1038607 | A2 | 9/2000 |
| EP | 1048372 | B1 | 6/2004 |
| EP | 1882652 | A1 | 1/2008 |
| EP | 1848556 | B1 | 8/2008 |
| EP | 2233221 | A2 | 9/2010 |
| GB | 2169993 | A | 7/1986 |
| GB | 2298637 | A | 9/1996 |
| JP | 6478781 | A | 3/1989 |
| WO | 0054904 | A1 | 9/2000 |
| WO | 2005011894 | A1 | 2/2005 |

* cited by examiner

Fig. 1
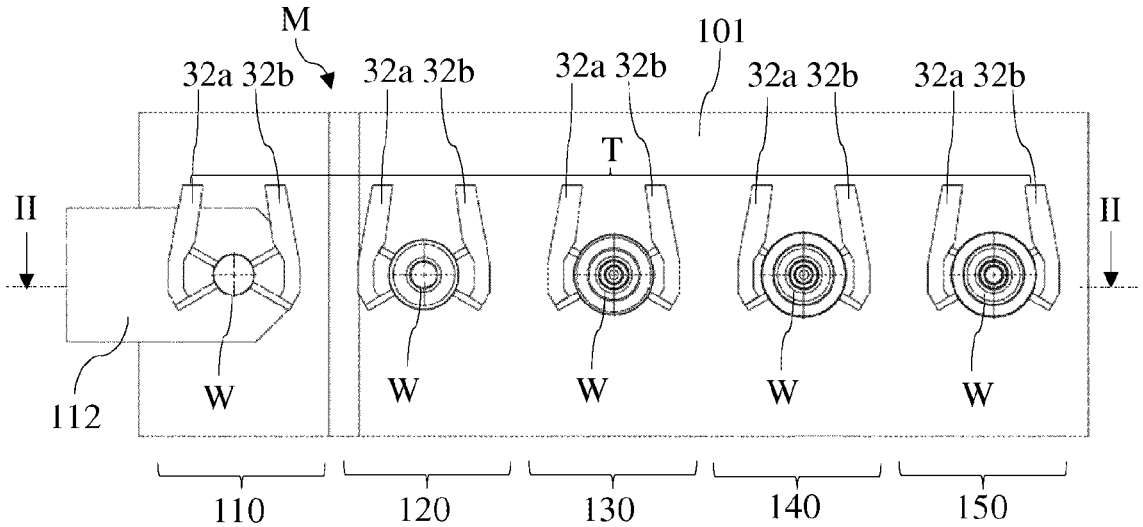
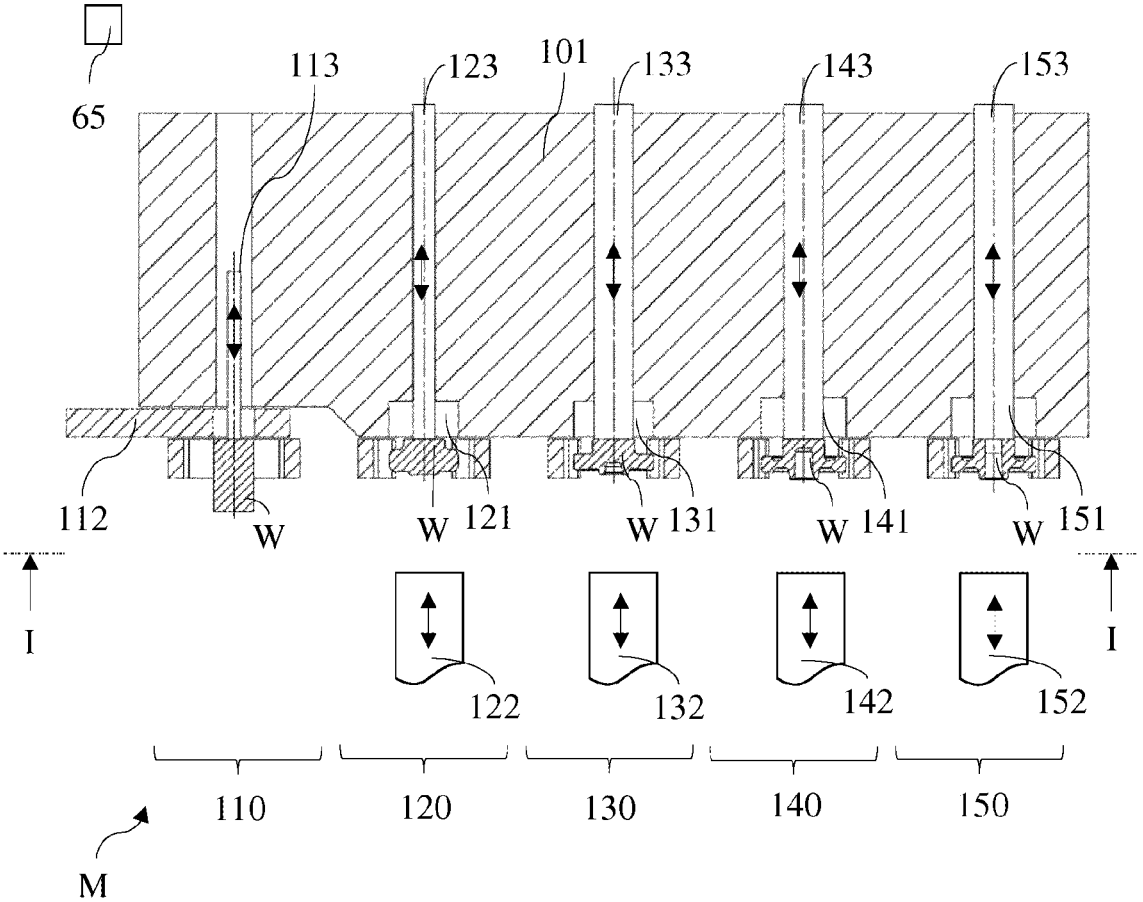
Fig. 2

Fig. 3
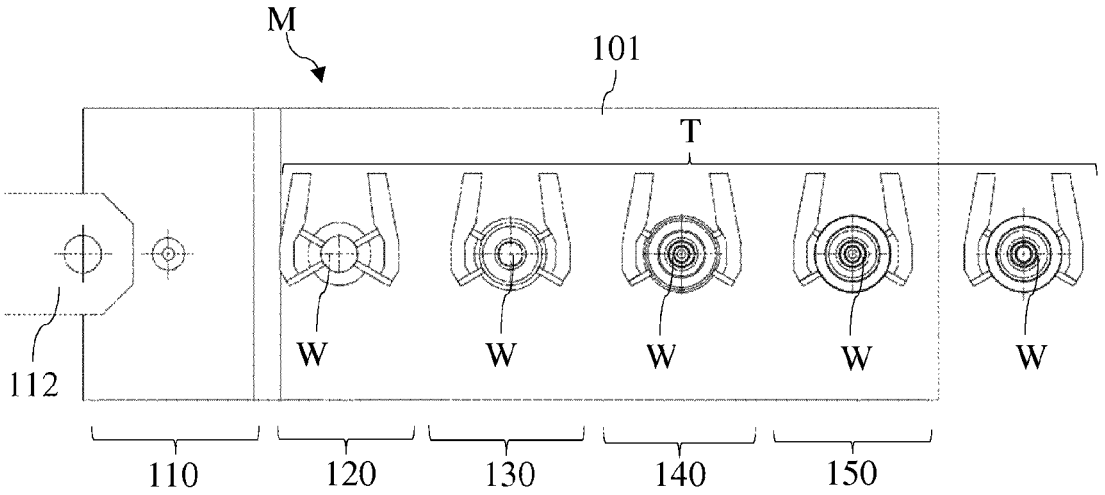
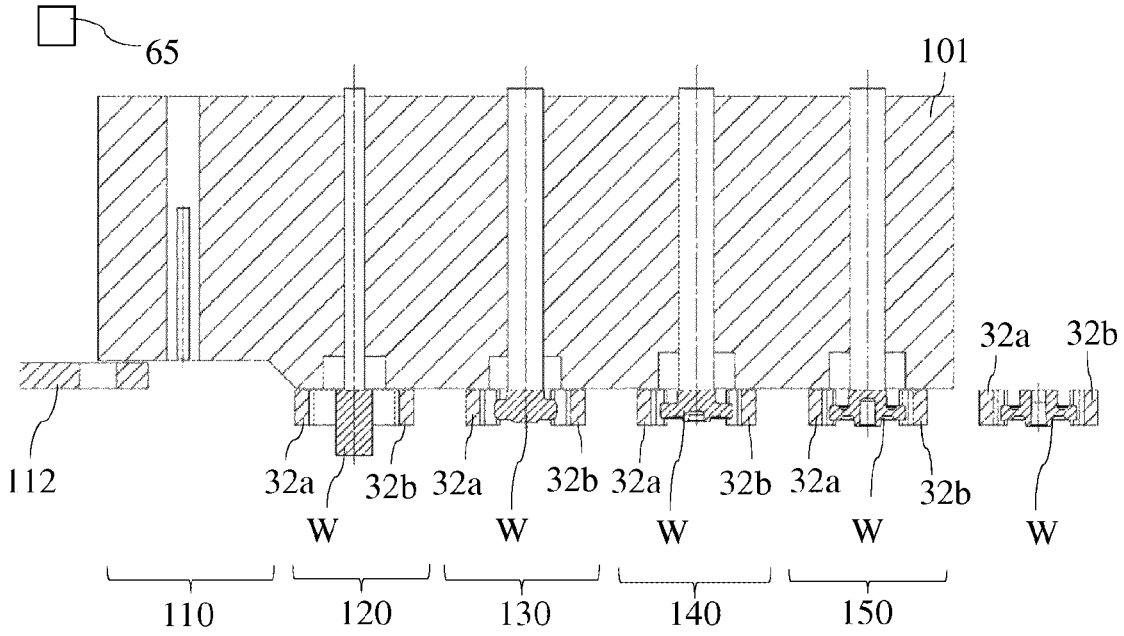
Fig. 4

Fig. 5
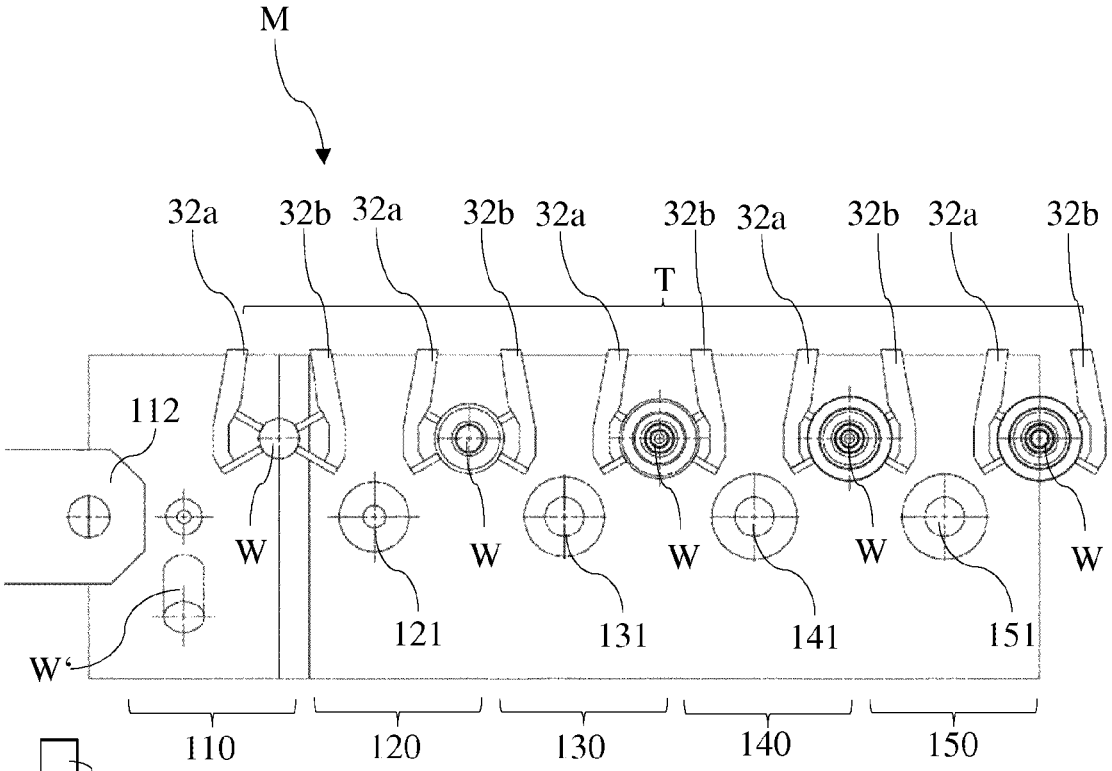
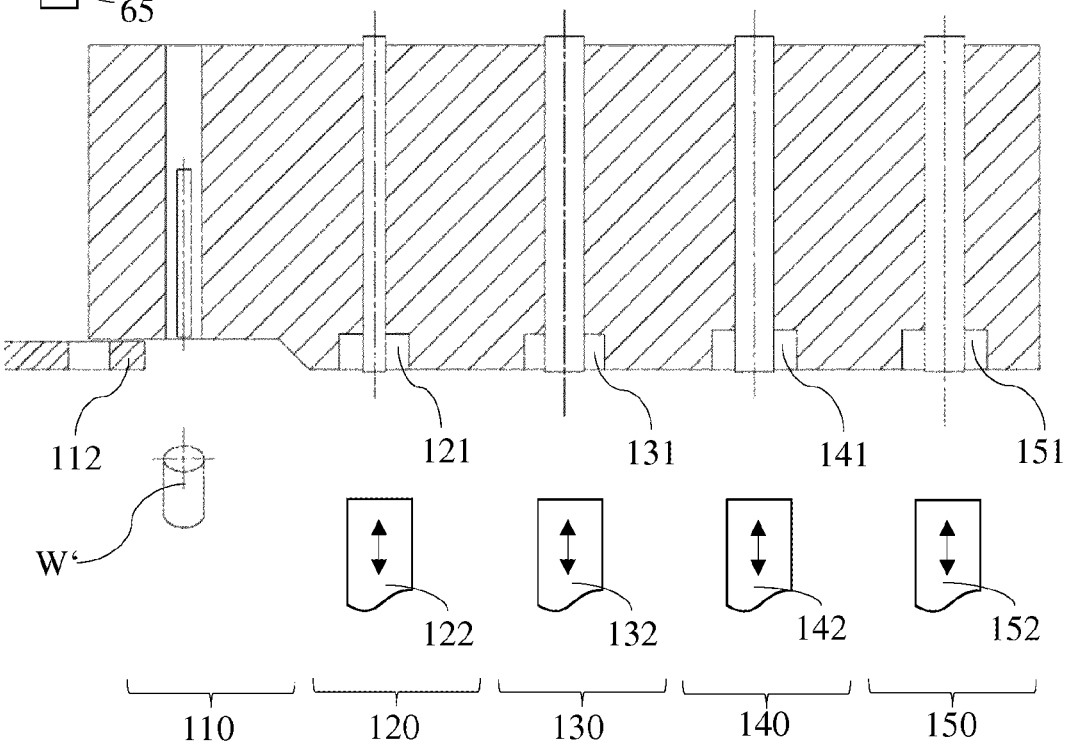
Fig. 6

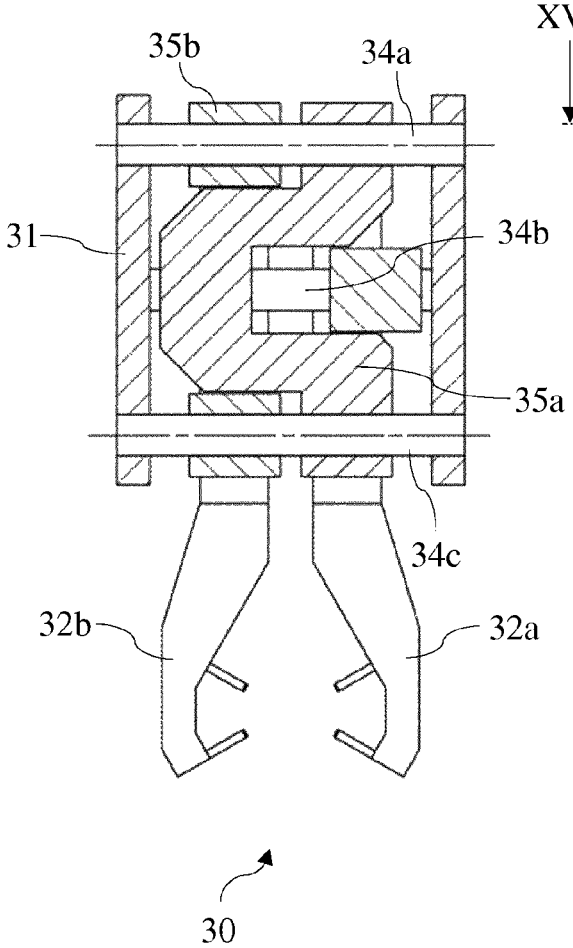
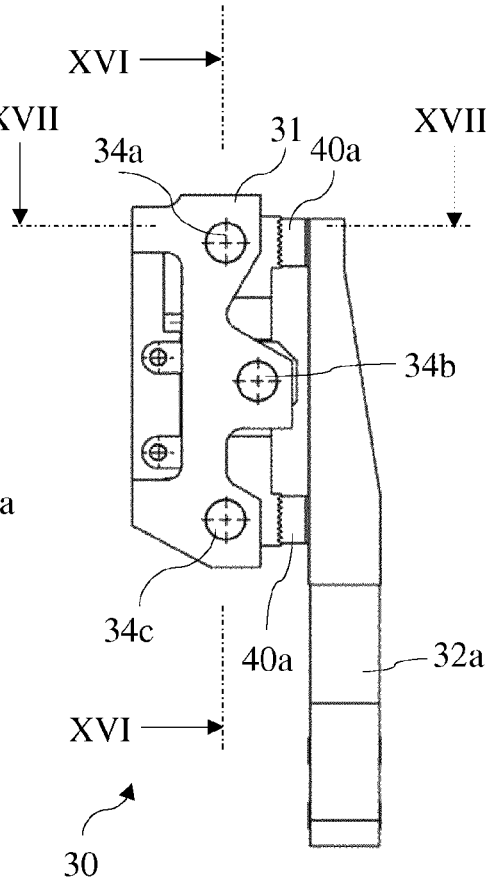
Fig. 16
Fig. 15

TRANSPORT METHOD FOR TRANSFERRING WORKPIECES

This application is the United States national phase of International Application No. PCT/EP2017/059724 filed Apr. 25, 2017, and claims priority to Switzerland Patent Application No. 000562/16 filed Apr. 28, 2016, the disclosures of which are hereby incorporated in their entirety by reference.

BACKGROUND OF THE INVENTION

Field of the Invention

The invention relates to a transport method for transferring workpieces between a plurality of successive stations of a processing device, especially a forming device.

Description of Related Art

In mass-forming and also in other forming operations or processing operations generally workpieces often pass through a number of stations of a processing device in succession, the workpieces being transported on from station to station. In a forming device, the stations are typically a loading station and various forming stations. To transport the workpieces from station to station there are usually used transport apparatuses which are equipped with tongs-like gripping tools and which operate in time with the rhythm of the processing device, the gripping tools simultaneously grasping the workpieces, withdrawing them from a station and supplying them to the respective next station, where they release them.

In the case of the known processing devices, especially forming devices, the transport movements and the operation of the gripping tools are coupled to the power train of the processing device see, for example, CH 595 155 A.

EP 2 233 221 A2 discloses a stamping apparatus for a progressive stamping press in which stamped parts are transported from one processing station to the next by means of gripping tools on a star-shaped rotating arm arrangement. The star-shaped rotating arm arrangement is rotated alternately in the clockwise direction and the anti-clockwise direction by a drive motor.

A transport apparatus for transferring workpieces in a forming device is described in EP 1 048 372 B1. In this known transport apparatus, a plurality of gripping tools configured as gripping tongs, each with a dedicated gripping tool drive which is decoupled from the power train of the forming device, are arranged on a common tong support which is movable in the longitudinal direction and transversely thereto and by means of which all the gripping tongs are jointly transported back and forth in each case between two adjacent stations of a forming device. The gripping tongs comprise two pivot arms which are driven by a servo motor via kinematic coupling members so as to be pivotable towards one another and away from one another. EP 1 048 372 B1 relates essentially to the configuration of the gripping tongs and the drives thereof; the drive of the tong support for carrying out the transfer movements of the gripping tongs is not specifically described.

In forming devices, especially hot forming devices, the raw material is usually supplied in the form of bars from which pieces of the required length are then cut off. The beginnings and ends of the bars are not permitted to enter the forming process and have to be discarded. Those discarded portions are missing from the forming process and create individual empty forming stations in the forming device. On account of the absence of forming force at those locations, the deformation of the machine body is altered, which has an adverse effect on the geometry of the formed parts. Depending upon the requirements, such parts cannot then be used and have to be manually sorted out from the finished parts or separated out by means of suitable separating devices. Since mechanical separation is not so accurate, it may happen that good formed parts are also separated out. In addition, an empty forming station undergoes greater cooling by cooling water, which has an adverse effect on the wear to the forming tools. This problem is described in detail, for example, in EP 1 848 556 B1.

EP 1 038 607 A2 discloses a transport apparatus and a transport method for transferring workpieces between a plurality of successive stations of a forming device, in which the workpieces are in each case transported from one station to the respective next station of the forming device simultaneously by means of a plurality of gripping tools which are movable jointly in a transport cycle. At the end of each transport cycle the gripping tools without workpieces are moved into a home position. If a device for monitoring the supply of workpieces to the first station of the forming device detects the absence of a fresh workpiece, the gripping tools wait in the home position until a workpiece is supplied to the first station again. In this way empty forming stations during the forming operation are avoided.

A further problem of conventional transport apparatuses and of the transport methods performed therewith is that in the event of process disturbances, which are caused, for example, by empty gripping tools or by workpieces incorrectly inserted into the gripping tools or by damaged parts, such as, for example, broken-off gripping tools or fractured punches etc., it is not possible to react immediately and so workpieces are not shaped as desired or often even considerable consequent damage can be caused to the transport apparatus or to the processing device.

Against this background a problem underlying the invention is to improve a transport method of the kind mentioned at the beginning and a corresponding transport apparatus to the effect that it is possible to react easily and quickly to process disturbances, so that consequent damage can be avoided. A particular objective is to be able to avoid empty locations in the stations of the processing device.

SUMMARY OF THE INVENTION

That problem is solved by the transport method according to the invention and by the transport apparatus according to the invention.

In respect of the method, the core of the invention lies in the following: in a transport method for transferring workpieces between a plurality of successive stations of a processing device, especially a forming device, the workpieces are in each case transported from one station to the respective next station of the processing device simultaneously by means of a plurality of gripping tools which are movable jointly in a transport cycle. In the event of a process disturbance, the transport cycle is suspended and the gripping tools with the workpieces are moved into a waiting position in which the workpieces are outside the operating range of processing tools of the stations of the processing device. Once the process disturbance has been eliminated, the transport cycle of the workpieces is resumed.

By virtue of the movement of the gripping tools into a safe waiting position outside the operating range of the processing tools of the stations, consequent damage resulting from the process disturbance can be prevented.

The method is especially advantageous if the process disturbance has been caused by a missing workpiece or by a workpiece unsuitable for processing in a loading station of the processing device, because it is thus possible to avoid empty processing stations and the disadvantages associated therewith.

The method is also advantageous if the process disturbance has been caused by a missing workpiece or by a workpiece incorrectly inserted into a gripping tool, because it is thus likewise possible to avoid empty processing stations or further disturbances caused by the incorrectly inserted workpiece.

The method is also advantageous if the process disturbance has been caused by a damaged part of a gripping tool or by a damaged part of the processing device, because it is in that way possible to avoid further consequent damage.

Advantageously the absence of a workpiece or the presence of a workpiece unsuitable for processing is detected by means of a sensor device, in which case the movement of the gripping tools into the waiting position is initiated by the sensor device. This allows the gripping tools to be moved automatically into the waiting position in the event of a process disturbance caused by the absence of a workpiece or the presence of a workpiece unsuitable for processing.

Advantageously the absence of a workpiece or the presence of a workpiece incorrectly inserted into a gripping tool is detected by means of a gripping tool controller of a gripping tool drive, in which case the movement of the gripping tools into the waiting position is initiated by the gripping tool controller. This allows the gripping tools to be moved automatically into the waiting position in the event of a process disturbance caused by the absence of a workpiece or the presence of a workpiece incorrectly inserted into a gripping tool.

In respect of the transport apparatus for simultaneously transferring workpieces between a plurality of successive stations of a processing device, especially a forming device, the core of the invention lies in the following: the transport apparatus comprises a movably mounted gripping tool support on which there are arranged a plurality of gripping tools, each for gripping one workpiece, a motor-driven gripping tool support drive for back and forth movement of the gripping tool support with the gripping tools between the stations of the processing device, and a support controller for the gripping tool support drive, which controller is configured to control the movement of the gripping tool support and, as a result of a control command supplied thereto, to move the gripping tool support with the gripping tools into a waiting position by means of the gripping tool support drive. The gripping tool support drive and the support controller are configured to move the gripping tool support with the gripping tools with workpieces into the waiting position and to suspend the transport of the workpieces.

By means of the transport apparatus according to the invention, the transport of workpieces can easily be suspended in the event of a process disturbance and the gripping tool support with the gripping tools can easily be moved into a safe position, so that consequent damage can be avoided.

Advantageously the gripping tool support is, on the one hand, mounted so as to be movable in a linearly guided way and, on the other hand, mounted so as to be displaceable transversely with respect to its linearly guided movability by means of a parallelogram guide arrangement. Furthermore, the gripping tool support is advantageously movable by means of a gripping tool support drive comprising two crank gear arrangements each having an associated gripping tool support drive motor, wherein each crank gear arrangement has a crank, which is drivable in rotation by the associated gripping tool support drive motor, and a drive rod which is articulatedly connected on the one hand to the crank and on the other hand to the gripping tool support.

By virtue of the dedicated gripping tool support drive, the transport apparatus is decoupled from the power train of the processing device. The decoupling and the displaceability of the gripping tool support transversely with respect to its linear back and forth movement enables the gripping tool support to be quickly moved into a safe position in the event of a disturbance. The kinematic coupling of the gripping tool support to the gripping tool support drive motors via two crank gear arrangements allows simple control of the movement sequences solely by corresponding actuation of the gripping tool support drive motors.

Advantageously the gripping tool support with the gripping tools is movable by means of the gripping tool support drive in a forward movement along a first linear path of movement and in a return movement along a second linear path of movement parallel to the first linear path of movement. As a result of the spacing between the two linear paths of movement, the gripping tools can in a simple way be moved out of the operating range of processing tools in the stations of the processing device.

Very especially advantageously the transport apparatus has a sensor device for detecting a process disturbance caused by a missing workpiece or by a workpiece unsuitable for processing, and for signalling that disturbance to the support controller. As a result, the support controller can be automatically caused to move the gripping tools into the waiting position.

Advantageously the gripping tools are each assigned a gripping tool drive, which is arranged on the gripping tool support, for individual operation of the gripping tools, and a gripping tool controller which is configured to control the opening and closing movements and preferably also the clamping force of the individual gripping tools individually and to recognise a process disturbance caused by an empty gripping tool or by a workpiece incorrectly inserted into a gripping tool and to signal that disturbance to the support controller. As a result, the support controller can be automatically caused to move the gripping tools into the waiting position.

BRIEF DESCRIPTION OF THE DRAWINGS

The invention is described in greater detail below with reference to an exemplary embodiment shown in the drawings, wherein:

FIGS. 1-6—are diagrammatic representations and sectional views of the processing device in various phases of a working sequence;

FIG. 15—is a side view of the gripping tool unit according to FIG. 11;

FIG. 16—shows a section through the gripping tool unit according to line XVI-XVI of FIG. 15;

DESCRIPTION OF THE INVENTION

Figure 7:
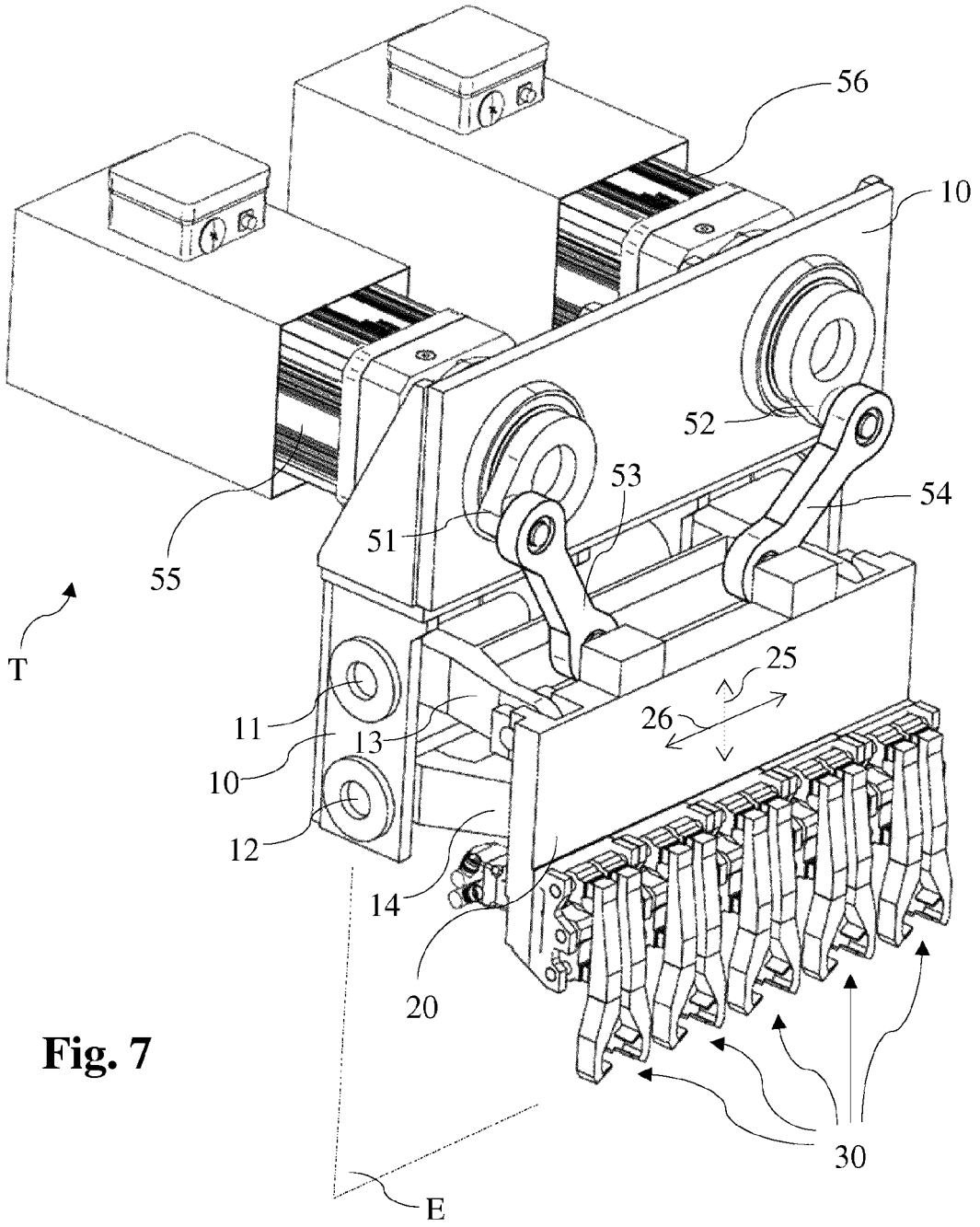
FIG. 7—is a perspective overall view of the transport apparatus of the processing device according to FIGS. 1-6.
Figure 8:
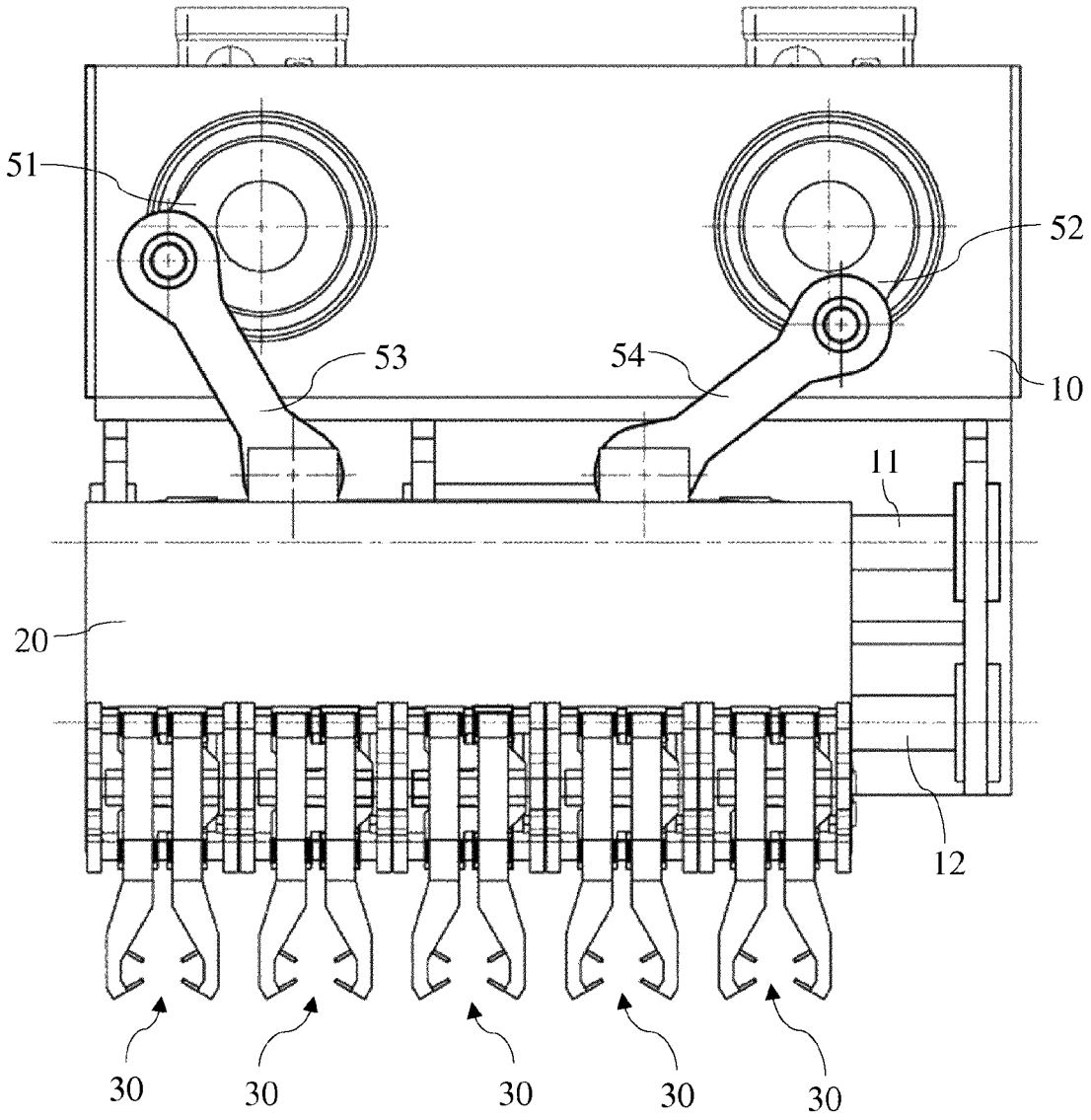
FIG. 8—is a front view of the transport apparatus.

The following observations apply in respect of the description which follows: where, for the purpose of clarity of the drawings, reference signs are included in a Figure but are not mentioned in the directly associated part of the description, reference should be made to the explanation of those reference signs in the preceding or subsequent parts of the description. Conversely, to avoid overcomplication of the drawings, reference signs that are less relevant for immediate understanding are not included in all Figures. In that case, reference should be made to the other Figures.

The diagrammatic overviews of FIGS. 1-6 show the parts of the processing device according to the invention that are relevant for understanding the present invention, in this case using the example of a forming device. While FIG. 1 is a view from the front according to line I-I in FIG. 2, FIG. 2 is a sectional view according to line II-II in FIG. 1. Correspondingly, FIGS. 3 and 5 are views from the front and FIGS. 4 and 6 are associated sectional views.

In the exemplary embodiment shown, the forming device, indicated as a whole by reference sign M, comprises five stations 110, 120, 130, 140, 150, arranged one next to the other, of which a first station 110 is a loading station and the other stations 120, 130, 140 and 150 are forming stations. The forming stations 120, 130, 140 and 150 comprise four forming dies 121, 131, 141 and 151 arranged in a common die holder 101, four forming tools in the form of punches 122, 132, 142 and 152 and four ejection elements 123, 133, 143 and 153, with which workpieces W that have been shaped in the forming dies by means of the punches can be ejected from the forming dies. The loading station 110 comprises a shearing device 112 for shearing off a workpiece W from a bar material (not shown, supplied by means of a bar material feed device, likewise not shown) and an ejection element 113, with which a workpiece W can be ejected from the shearing device 112. A transport apparatus, indicated as a whole by reference sign T, serves for transferring the workpieces from one station to the respective next station of the forming device M. Of the transport apparatus T, FIGS. 1-6 each show only gripping tools, each having a pair of tong arms 32*a* and 32*b*.

During operation of the forming device, in a starting position the tongs-like gripping tools of the transport apparatus T, which are formed by the pairs of tong arms 32*a* and 32*b*, each pick up a workpiece W which is held in readiness in the loading station 110 or has been ejected from the forming dies 121, 131, 141 and 151 of the forming stations 120, 130, 140 and 150 (FIGS. 1 and 2) and then transport those workpieces W simultaneously to the respective next station of the forming device M, the finished shaped workpiece W picked up from the last forming station 150 being released so that it can be discharged from the forming device. FIGS. 3 and 4 illustrate this. In forming stations 120, 130, 140 and 150, the workpieces W are inserted into the forming dies 121, 131, 141 and 151 and subjected to forming by means of the punches 122, 132, 142 and 152. The transport apparatus T then returns the (empty) gripping tools to the starting position shown in FIGS. 1 and 2. There the gripping tools each pick up a fresh workpiece W which is held in readiness in the loading station 110 or has been ejected from the forming dies 121, 131, 141 and 151 of the forming stations 120, 130, 140 and 150 and again transport those workpieces to the next station of the forming device, as shown in FIGS. 3 and 4. The entire sequence takes place in a transport cycle in time with the rhythm of the forming to device M.

It is clear from the above brief description of the transfer operation that in each transfer cycle each gripping tool transports a different workpiece and each pair of adjacent stations of the processing device is served by a different gripping tool. In the context of the present invention the transfer of workpieces from station to station of the processing device by means of a plurality of gripping tools is to be understood in this sense.

Thus far the processing or forming device M shown corresponds in structure and mode of operation to conventional processing or forming devices of this kind, so that the person skilled in the art requires no further explanation in this regard.

The transport apparatus of the processing or forming device M is explained in detail below with reference to FIGS. 7-17. The transport apparatus, indicated as a whole by reference sign T, comprises a fixed frame 10, a plate-like gripping tool support 20, which is arranged to be movable in or on the frame 10 and which in the example herein supports five gripping tool units 30, and a gripping tool support drive. The gripping tool units 30 are all arranged at the same distance from a common reference plane E (FIG. 7). A front face of the plate-like gripping tool support 20, facing towards the gripping tool units, is aligned parallel to the reference plane E. The gripping tool support drive comprises two gripping tool support drive motors 55 and 56, which are each configured as servo motors having rotary encoders and gearing and are rigidly mounted on the frame 10. Furthermore, the tool support drive comprises two crank gear arrangements which each have a crank 51, 52 and a drive rod (connecting rod) 53, 54, respectively. The cranks 51 and 52 are each rigidly mounted on a rotatable part of the gearing of the gripping tool support drive motors 55 and 56, respectively, and are drivable in rotation thereby. In practical use, the frame 10 is mounted on the machine body (not shown) of the forming device M so as to be detachable or pivotable away, so that access can easily be gained to the forming dies and to the forming tools.

Figure 9:
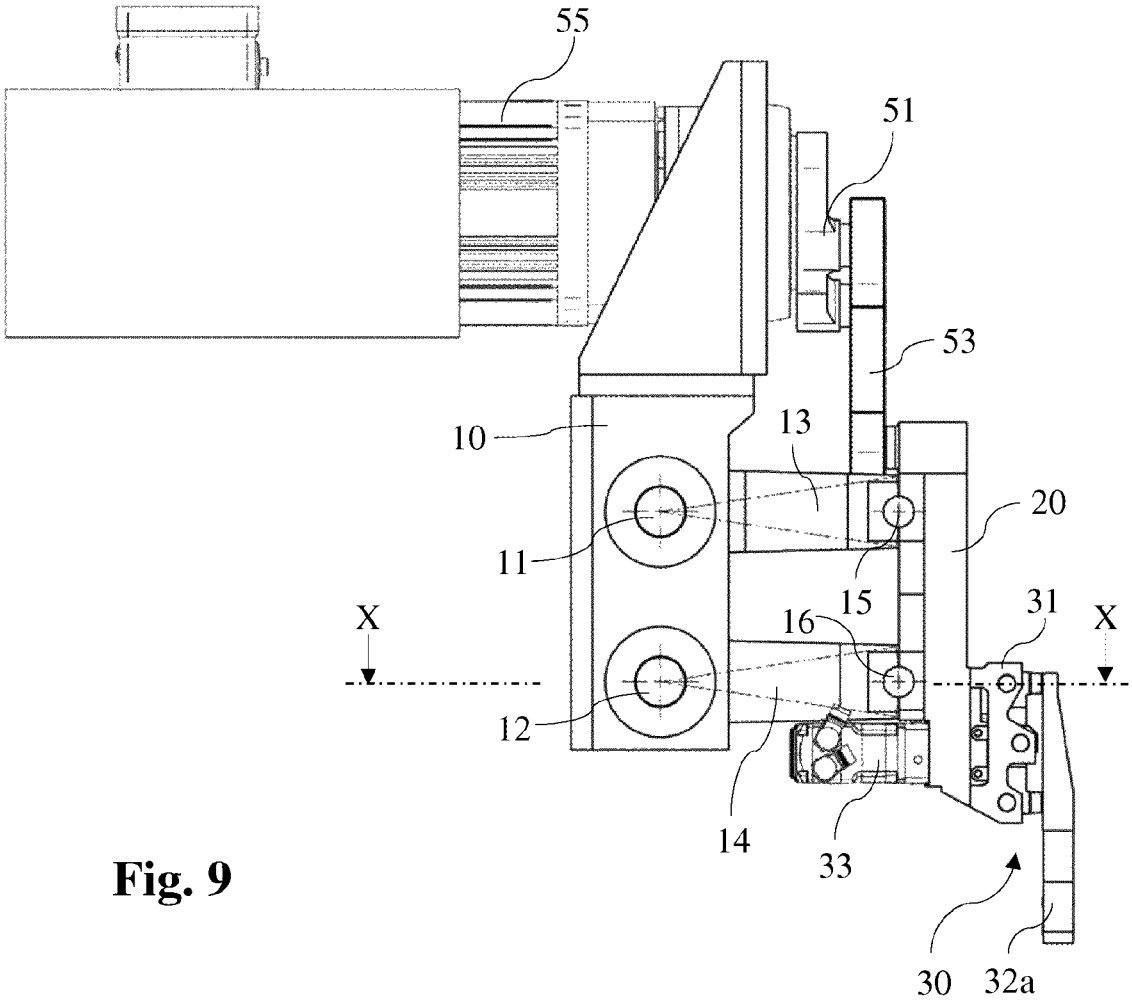
FIG. 9—is a side view of the transport apparatus.
Figure 10:
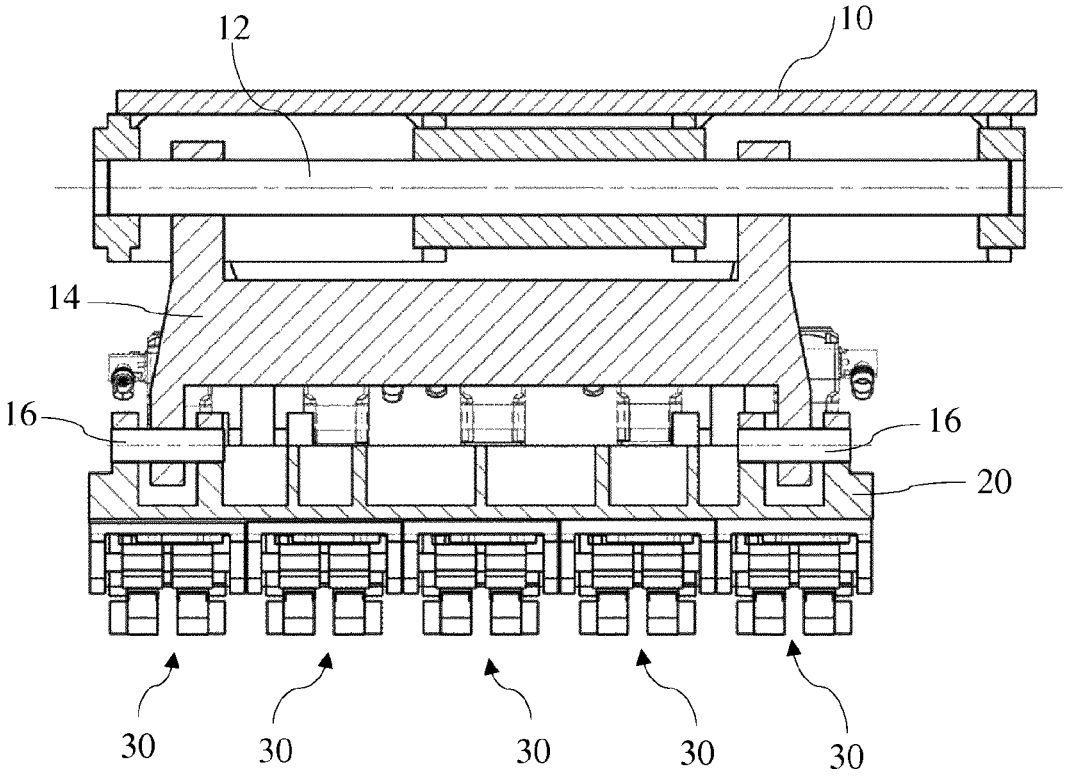
FIG. 10—shows a section through the transport apparatus according to line X-X of FIG. 9.

In the frame 10 there are arranged two parallel guide rods 11 and 12 (FIGS. 7-10), the axes of which define the reference plane E (FIG. 7). Two link rods 13 and 14 are guided along or on those guide rods 11 and 12 so as to be linearly movable in the longitudinal direction of the guide rods. In addition, the two link rods 13 and 14 are each pivotally articulated about a respective one of the two guide rods 11 and 12. At their ends remote from the guide rods, the link rods 13 and 14 are pivotally attached to the gripping tool support 20 by means of journal pairs 15 and 16 (FIGS. 9 and 10). The distance between the two journal pairs 15 and 16 is the same as the distance between the two guide rods 11 and 12. The distance between the journal pair 15 and the guide rod 11 is the same as the distance between the journal pair 16 and the guide rod 12. The two parallel guide rods 11 and 12 and the two link rods 13 and 14 together with the gripping tool support 20 accordingly form a parallelogram guide arrangement for the latter, the gripping tool support 20 being displaceable in both directions (upwards and downwards in the Figures) transversely with respect to the longitudinal direction of the guide rods 11 and 12. In FIG. 7 this is symbolised by the double-headed arrow 25. At the same time, via the slidably mounted link rods 13 and 14, the gripping tool support 20 is movable back and forth along the guide rods 11 and 12 in the longitudinal direction thereof in a guided way, this being indicated in FIG. 7 by the double-headed arrow 26. Therefore the gripping tool support 20 is, on the one hand, guided so as to be linearly movable parallel to the reference plane E and, on the other hand, mounted so as to be displaceable substantially parallel to the reference plane transversely with respect to its linear movability.

Each of the drive rods (connecting rods) 53 and 54 is rotatably articulated by one end on the crank 51 and 52, respectively, and by its other end on the gripping tool support 20. By corresponding rotation of the two cranks 51 and 52 by means of the two gripping tool support drive motors 55 and 56, the gripping tool support 20 can be moved as desired (within predetermined limits) in the direction of the double-headed arrow 26 and/or the double-headed arrow 25.

An advantage of the parallelogram guidance is that the gripping tool support 20, during its transverse displacement (pivoting movement about the guide rods), performs only a small movement perpendicular to its displacement movement, that is to say perpendicular to the reference plane E.

Figure 19:
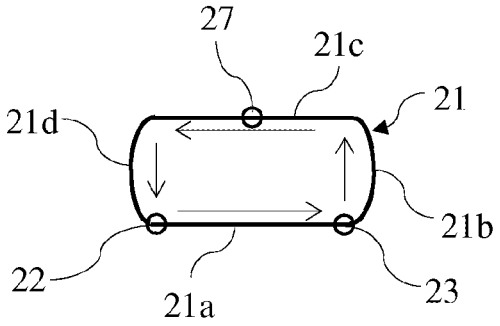
FIG. 19—shows a diagrammatic path of movement of the gripping tools of the transport apparatus during normal operation.

FIG. 19 shows in diagrammatic form a typical path of movement of the gripping tool support 20 and accordingly of the gripping tool units 30 attached thereto. The closed, cyclically followed path of movement 21 comprises four movement path sections 21*a*-21*d*. The two linear movement path sections 21*a* and 21*c* correspond to the linearly guided sliding movement of the gripping tool support 20 along the guide rods during the forward movement and return movement between the stations of the forming device, while the two movement path sections 21*b* and 21*d* result from the displacement of the gripping tool support 20 by means of the parallelogram guide arrangement. The points 22 and 23 mark the starting position of the gripping tool support 20 shown in FIG. 1 and its position displaced by one station shown in FIG. 3, respectively. As FIG. 19 shows, the forward movement of the gripping tool support 20 takes place along a first linear path of movement (movement path section 21*a*), while the return movement of the gripping tool support 20 takes place along a linear path of movement (movement path section 21*c*) parallel to the first linear path of movement. The distance between the two linear paths of movement resulting from the displacement of the gripping tool support 20 is selected so that at the level of the second linear path of movement the gripping tool units 30 arranged on the gripping tool support 20, or rather the gripping tools thereof, are located outside the engagement range of the forming tools 122, 132, 142, 152 in the forming stations 120, 130, 140, 150, as can be seen from FIG. 5. Reference sign 27 marks a waiting position, which will be discussed further hereinbelow.

The gripping tool units 30 arranged one next to the other on the gripping tool support 20 are all identically constructed. Their structure will be apparent from FIGS. 11-17.

Figure 14:
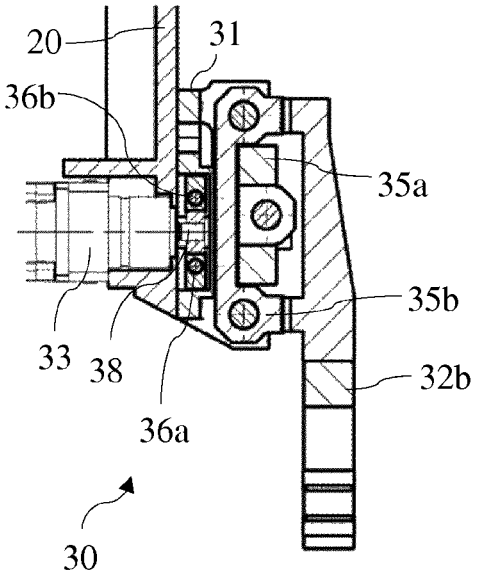
FIG. 14—shows a section through the gripping tool unit according to line XIV-XIV of FIG. 13.
Figure 13:
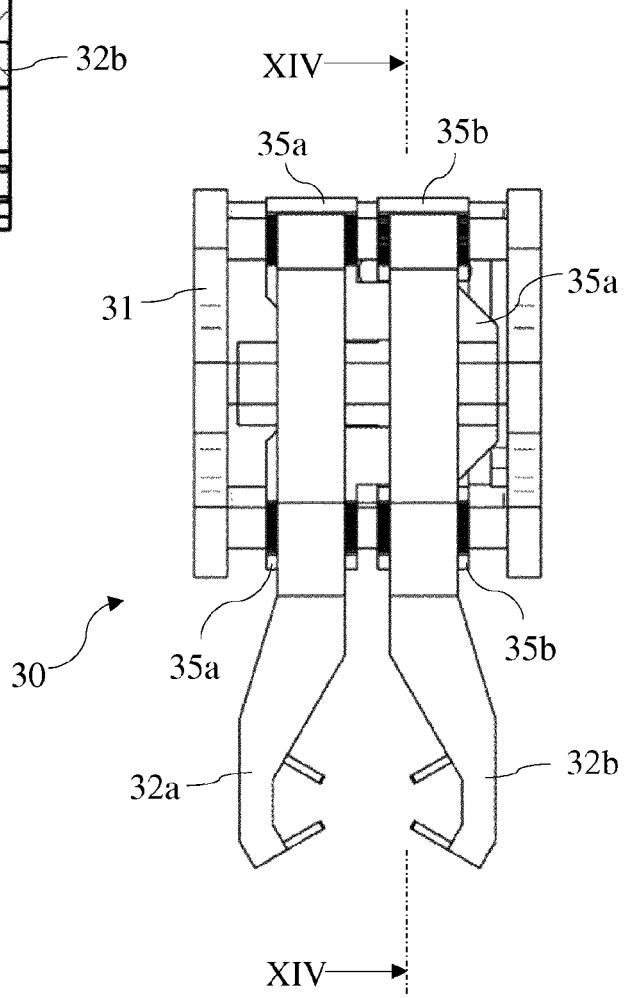
FIG. 13—is a front view of the gripping tool unit of FIG. 11.

Each gripping tool unit 30 comprises a tong body 31, a pair of movable tong arms 32*a* and 32*b* forming gripping tongs, and a gripping tool drive in the form of an (electric) servo motor 33 having a rotary encoder and gearing, the servo motor being shown only in FIGS. 9 and 14. The tong body 31 and the servo motor 33, including the gearing, are each mounted on the gripping tool support 20. The two tong arms 32*a* and 32*b* are movably arranged on the tong body 31.

In the tong body 31, two tong carriages 35*a* and 35*b* are displaceably mounted on three guide rods 34*a*, 34*b* and 34*c*. The tong carriages 35*a* and 35*b* are each kinematically connected to a respective toothed rod 37*a* and 37*b* via a drive rod 36*a* and 36*b*, respectively, so that a movement of the toothed rods brings about a concomitant movement of the tong carriages and vice versa. The two toothed rods 37*a* and 37*b* are in engagement with a drive pinion 38 on diagonally opposite sides thereof, which drive pinion is drivable in rotation by the servo motor 33 (via the gearing thereof), so that on rotation of the drive pinion 38 the two toothed rods 37*a* and 37*b* move in opposite directions and accordingly the two tong arms 32*a* and 32*b* are moved towards one another or away from one another. The opening and closing movement of the gripping tongs formed by the tong arms 32*a* and 32*b* is therefore effected by the servo motor 33 or the drive pinion 38 driven thereby.

The gripping tool drive can alternatively also be in the form of a servo-controlled (having servo valves) hydraulic drive. What is important in that case is that, on the one hand, the movement of the gripping tongs can be effected very quickly and, especially, with position control and, on the other hand, the clamping force of the two tong arms can be precisely adjusted or controlled and fed back, as is also true in the case of the above-described gripping tool drive having the electric servo motor.

Figure 11:
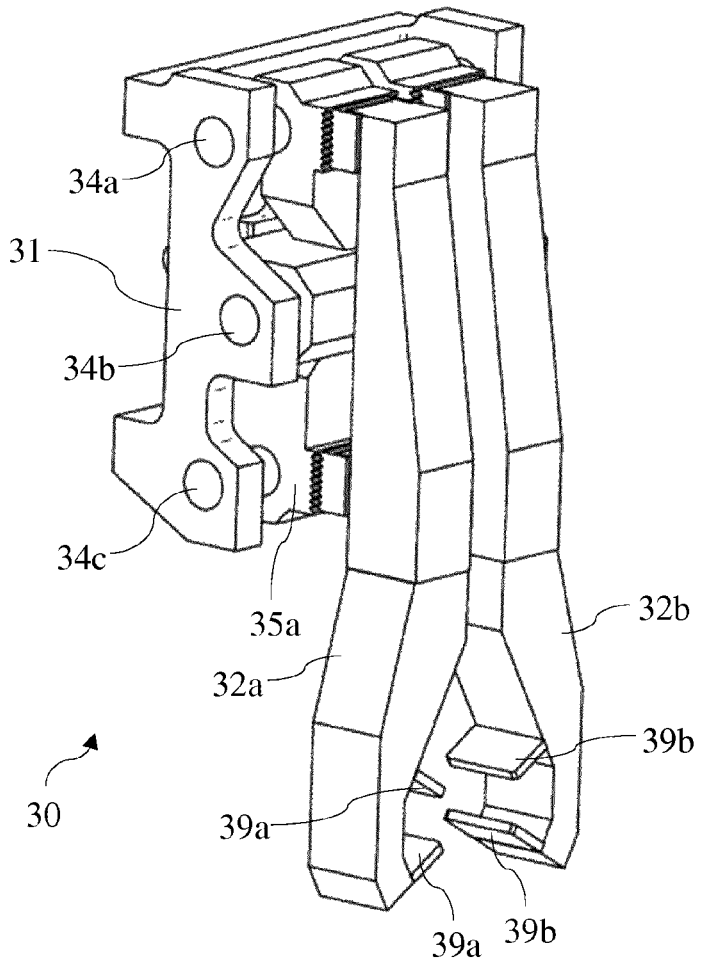
FIG. 11—is a perspective view of a gripping tool unit of the transport apparatus.
Figure 12:
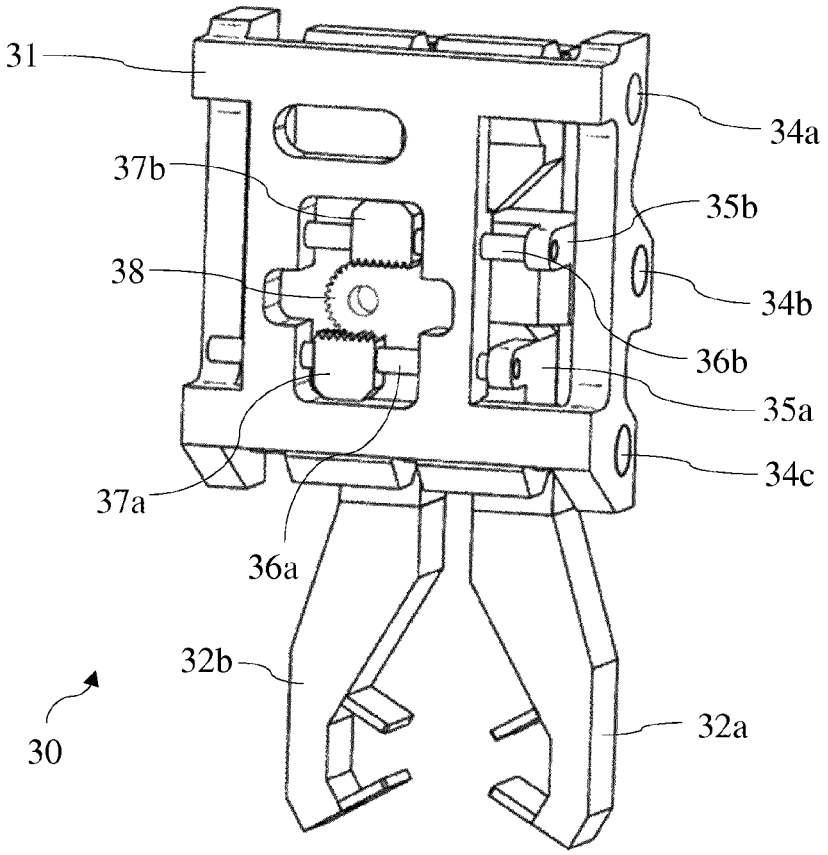
FIG. 12—is a perspective rear view of the gripping tool unit of FIG. 11.

At the free ends of the two tong arms 32*a* and 32*b* there are arranged tong shoes 39*a* and 39*b* which serve for gripping the workpieces and are exchangeably attached, so that the gripping tongs can easily be matched to the shape of the workpieces being gripped (FIG. 11). The tong shoes need not be configured and/or arranged in the same way on all the gripping tongs. Preferably on each tong arm there are arranged, as shown, two tong shoes which together form an especially advantageous four-point holding arrangement for the workpieces being gripped. Such a four-point holding arrangement on the one hand enables the workpieces to be held securely and on the other hand reduces the risk of the workpieces tilting, especially when being introduced into closed gripping tongs.

Figure 17:
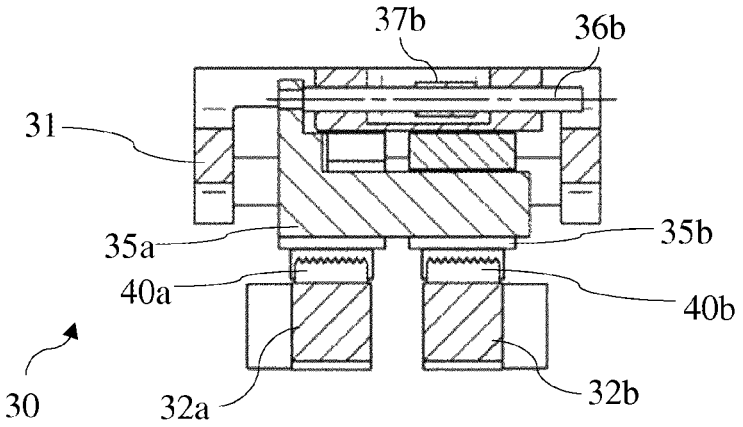
FIG. 17—shows a section through the gripping tool unit according to line XVII-XVII of FIG. 15.

The tong arms 32*a* and 32*b* are each releasably connected to the tong carriages 35*a* and 35*b* via a pair of serrated plates 40*a* and 40*b*, respectively (FIGS. 15 and 17). In this way the tong arms 32*a* and 32*b* can easily be adjusted laterally or in height relative to the respective tong carriages 35*a* and 35*b* in order, for example, to adapt the gripping tongs to the particular workpiece.

It will be understood that in the transport apparatus according to the invention, instead of gripping tongs it is also possible to use gripping tools of some other configuration. For example, the gripping tools could also be in the form of vacuum grippers. For use in a forming device, however, gripping tools in the form of gripping tongs are customary and proven.

Figure 18:
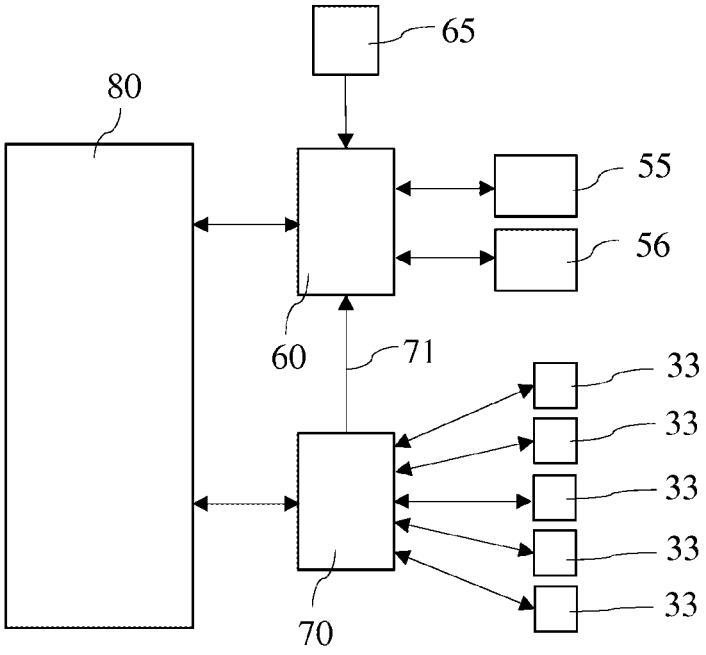
FIG. 18—is a diagrammatic representation of a control arrangement of the processing device or rather the transport apparatus thereof.

As shown diagrammatically in FIG. 18, the transport apparatus T also comprises a support controller 60 for the gripping tool support drive motors 55 and 56 and also a gripping tool controller 70 for actuating the gripping tool drive motors 33 of the individual gripping tool units 30. The gripping tool controller 70 is configured to control the opening and closing movements and the clamping force of the individual gripping tools, here gripping tongs 32*a* and 32*b*, individually. The support controller 60 calculates the rotated positions of the two cranks 51 and 52 necessary for travelling along the path of movement 21 of the gripping tool support 20 and controls the servo motors 55 and 56 accordingly. Moreover, the support controller 60 co-operates with a sensor device 65 which is configured to recognise a process disturbance caused, for example, by an unprocessable or missing workpiece W' in the loading station 110 and to signal that disturbance to the support controller 60.

The sensor device 65, which is indicated only symbolically in FIGS. 2, 4 and 6, is assigned to the afore-mentioned bar material feed device (not shown) and can be, for example, a light barrier arrangement. Such sensor devices on bar feed devices are known per se and are described, for example, in EP 1 848 556 B1. The sensor device 65 is capable of recognising the beginnings and ends of bars. When the sensor device 65 recognises the beginning or end of a bar, it signals this to the support controller 60, so that the support controller knows that the next bar section is defective and must be discarded, that is to say is not permitted to enter the forming process. The support controller 60 then reacts to that process disturbance in the way explained in greater detail below.

The support controller 60 and the gripping tool controller 70 co-operate with a higher-level controller 80 which inter alia also makes the connection to the processing device and specifies at which position of the path of movement the gripping tool support or the gripping tools thereof should be located. By means of the higher-level controller 80, an operator can also input or modify settings, for example relating to the movement of the gripping tool support or to opening and closing movements of the gripping tongs. It will be understood that the functions of the support controller 60, the gripping tool controller 70 and the higher-level controller 80 can also be realised in some other configuration, for example they can be combined in a single controller.

As already mentioned at the beginning, in forming devices, especially hot forming devices, the raw material is usually supplied in the form of bars from which pieces of suitable length are then sheared off. The beginnings and ends of the bars are not permitted to enter the forming process and have to be discarded. Those discarded portions are missing from the forming process and create empty forming stations in the forming device, which should be avoided for the reasons explained at the beginning.

Because the drive of the gripping tool support 20, or of the gripping tools 32*a*, 32*b* arranged thereon, is independent and decoupled from the power train of the forming device, the above-described transport apparatus according to the invention makes it possible to avoid empty forming stations in a forming device.

Figure 20:
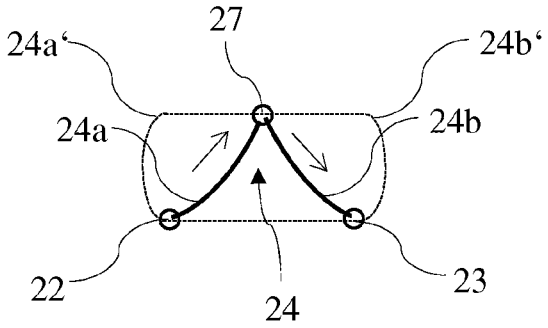
FIG. 20—shows a diagrammatic path of movement of the gripping tools in the event of a process disturbance.

If, for example, the mentioned sensor device 65 detects a process disturbance caused by a missing workpiece or by a workpiece W that is unsuitable for further processing and is to be discarded (FIGS. 5 and 6), the sensor device 65 sends a corresponding control command to the support controller 60 for the gripping tool support drive. The support controller 60 then causes the gripping tool support 20 with the gripping tool units 30 to depart from its customary path of movement 21 (FIG. 19) and instead causes the gripping tool support 20 with the workpieces W located in the gripping tool units 30 to be moved into a waiting position 27 (FIG. 20). The waiting position is located, for example, on the upper movement path section 21*c* of the gripping tool support 20, the tong arms 32*a* and 32*b* of the gripping tool units 30 being located above and between the tools 112, 122, 132, 142 and 152, so that they are out of range of the latter. This situation is shown in FIGS. 5 and 6. The forming tools then perform an empty stroke, but this has no adverse consequences because all the forming stations are empty. Preferably, the cooling of the tools is suspended during this phase, so that the tools and the workpieces located in the waiting position are not cooled. The defective workpiece W' is discarded (in a manner known per se). As soon as the sensor device 65 reports that a workpiece W suitable for the forming process is to arrive in the loading station 110 again, the support controller 60 causes the gripping tool support 20 to return to its original path of movement, the workpieces being transferred to the respective forming stations and the gripping tool support 20 then following its normal path of movement 21 into its starting position 22 shown in FIGS. 1 and 2 in order to pick up workpieces W in that position and then transport them to the respective next forming station.

FIG. 20 illustrates in graphic form the movement sequence of the gripping tool support 20 just described in the event of a process disturbance. The movement of the gripping tool support 20 into the waiting position 27 takes place along a movement path section 24*a* and the movement of the gripping tool support 20 from the waiting position 27 to position 23 takes place along a movement path section 24*b*. The overall path of movement from position 22 via the waiting position 27 to position 23 is denoted by reference sign 24. The movement path sections 24*a* and 24*b* need not necessarily follow the course shown in FIG. 20. The movement of the gripping tool support 20 can also take place, for example, along alternative movement path sections 24*a*' and 24*b*' which correspond to movement path sections 21*d* and 21*c*, and 21*c* and 21*b*, respectively, of the normal path of movement 21.

Decoupling the transport apparatus from the power train of the forming device enables the duration and route for transporting, lifting and gripping to be adjusted and varied independently of the stroke of the forming tools. "Lifting" is to be understood herein as the vertical displacement of the gripping tool support 20, the lifting stroke corresponding to the vertical distance between the two movement path sections 21*a* and 21*c*. The adjustment of the lifting and gripping movement decoupled from the stroke of the forming tools allows individual adaptation to the particular workpieces, with the result that wear to the machine is reduced. In addition, in the event of issues in the tool chamber, for example if a formed part has not been fully pushed out of the forming die or a broken punch is stuck in the forming die or a formed part has been lost from a gripping tool, it is thereby also possible to react to the situation and move the gripping tool support 20 with its gripping tool units 30 into a safe position, for example the mentioned waiting position 27, and to stop the forming device until the disturbance has been resolved. It is thereby possible, for example, to prevent gripping tools from being broken off or other consequent damage from being caused to the transport apparatus.

As already mentioned, the gripping tool units 30 are individually controllable by means of the gripping tool controller 70. As a result, the timepoint for opening and closing can be adjusted individually for each gripping tool unit. The opening stroke of the tong arms 32*a* and 32*b* and the duration of the movement can also be adapted to the workpiece in question. The same applies to the lifting movement. That movement can also be optimised for each workpiece in respect of stroke and duration, with the aim of keeping acceleration and accordingly load on the structure of the apparatus low. In contrast thereto, known transport apparatuses with control curves must always be designed for the maximum possible stroke, with the result that the components are subjected to maximum loading and accordingly maximum wear in the case of every workpiece or formed part.

In order to compensate for defects in the shape of the blank section or to achieve an off-centre predistribution of material, for example in the production of cams, it is necessary for the first gripping tongs or another gripping tongs to be positioned off-centre. In known transport apparatuses, eccentric adjusting elements are utilised for that purpose or the tong shoes are adjusted by trial and error so that the centre of the workpiece is shifted from the centre by the desired amount. The transport apparatus according to the invention enables the gripping tool support 20 to be moved out of the centre (zero position) by the desired amount by means of the gripping tool support drive motors 55 and 56 simply by inputting the desired values at the higher-level controller 80. The relevant gripping tongs are then aligned with a central adjusting element and then the gripping tool support is moved into its zero position again. In this way it is possible for one or more gripping tongs to be positioned off-centre. The remaining gripping tongs are adjusted when the gripping tool support 20 is central (in the zero position) again.

The clamping or holding force of each gripping tool unit 30 is controlled by means of the gripping tool controller 70 via the torque of the associated servo motor 33 and can in this way be simply adapted to the workpiece being held and optionally also varied over the movement cycle of the gripping tool support. The clamping force can be adjusted so that, for example, it is smaller when the workpieces are being introduced into the gripping tongs than it is for transport. The loading on the mechanical components is therefore only as high as necessary.

Servo motors usually have a rotary encoder for feeding back the current rotated position to its controller. Using the rotary encoder the gripping tool controller 70 can easily establish whether a gripping tool is loaded or empty, for example if a workpiece has been lost from a gripping tool, by comparing the actual rotated position with the desired rotated position, so that if necessary the forming device can be stopped. By suitable configuration of the gripping tool controller 70 it is thus possible also to recognise process disturbances caused, for example, by crookedly positioned workpieces in the gripping tools or by gripping tools tearing open. In that case this is signalled to the support controller 60 by the gripping tool controller 70 in a suitable way, and the support controller 60 then causes the gripping tool support 20 with the gripping tool units 30 to be moved into a safe position, for example the mentioned waiting position 27, where it is stopped until the process disturbance has been resolved. A gripping tool is at risk of tearing open when, for example, a workpiece is incompletely ejected from the die or if the punch breaks and sticks in the workpiece. On attempting to transport the workpiece, the gripping tool would tear open. The gripping tool controller 70 recognises this at an early stage, however, and, via the support controller 60, brings about a return movement of the gripping tool support, so that the gripping tool in question is prevented from tearing open. The gripping tool support 20 with the gripping tool units 30 is then moved into a safe position, for example the mentioned waiting position 27, where it is stopped until the process disturbance has been resolved. The forming device is of course stopped during that time. In this way it is possible to react immediately to a process disturbance before greater damage occurs. The co-operation of the gripping tool controller 70 with the support controller 60 is symbolised by arrow 71 in FIG. 18. The gripping tools or gripping tongs of the described transport apparatus have parallel tong arms 32*a* and 32*b* which are moved linearly towards one another and away from one another. Such gripping tongs have the advantage over gripping tongs with pivotable tong arms that the tong shoes reach uniformly into the gripping diameter. If the tong shoes engage the workpiece at the same angle on both sides, on introduction of the workpiece they are pressed against it by the same amount. This reduces the risk of a workpiece being pushed crookedly into the gripping tongs.

The invention claimed is:

1. A transport method for transferring workpieces between a plurality of successive stations of a processing device, wherein the method comprises the steps of:

a) transporting each workpiece from one station to a respective next station of the processing device simultaneously by a plurality of gripping tools which are movable jointly in a transport cycle, b) in the event of a process disturbance, suspending the transport cycle and moving the gripping tools with the workpieces into a waiting position in which the workpieces are outside an operating range of processing tools of the stations of the processing device and, c) once the process disturbance has been eliminated, resuming step a).

2. The method according to claim 1, wherein the process disturbance has been caused by a missing workpiece or by a workpiece unsuitable for processing in a loading station of the processing device.

3. The method according to claim 1, wherein the process disturbance has been caused by a missing workpiece or by a workpiece incorrectly inserted into a gripping tool.

4. The method according to claim 1, wherein the process disturbance has been caused by a damaged part of a gripping tool or by a damaged part of the processing device.

5. The method according to claim 2, further comprising the steps of:

detecting by a sensor device the absence of a workpiece or the presence of a workpiece unsuitable for processing, and initiating by the sensor device the movement of the gripping tools into the waiting position.

6. The method according to claim 3, further comprising the steps of:

detecting by a gripping tool controller of a gripping tool drive the absence of a workpiece or the presence of a workpiece incorrectly inserted into a gripping tool; and initiating by the gripping tool controller the movement of the gripping tools into the waiting position.

7. A transport apparatus for simultaneously transferring workpieces between a plurality of successive stations of a processing device, wherein the transport apparatus comprises:

a movably mounted gripping tool support on which there are arranged a plurality of gripping tools, each for gripping one workpiece, a motor-driven gripping tool support drive for back and forth movement of the gripping tool support with the gripping tools between the stations of the processing device, and a support controller for the gripping tool support drive, which controller is configured to control the movement of the gripping tool support and, as a result of a control command supplied thereto, to move the gripping tool support with the gripping tools into a waiting position by the gripping tool support drive, wherein the gripping tool support drive and the support controller are configured to move the gripping tool support with the gripping tools with workpieces into the waiting position and to suspend the transport of the workpieces.

8. The transport apparatus according to claim 7, wherein the gripping tool support is, on the one hand, mounted so as to be movable in a linearly guided way and, on the other hand, mounted so as to be displaceable transversely with respect to its linearly guided movability by a parallelogram guide arrangement.

9. The transport apparatus according to claim 8, wherein the gripping tool support is movable by a gripping tool support drive comprising two crank gear arrangements each having an associated gripping tool support drive motor, wherein each crank gear arrangement has a crank, which is drivable in rotation by the associated gripping tool support drive motor, and a drive rod which is articulatedly connected on the one hand to the crank and on the other hand to the gripping tool support.

10. The transport apparatus according to claim 7, wherein the gripping tool support with the gripping tools is movable by the gripping tool support drive in a forward movement along a first linear path of movement and in a return movement along a second linear path of movement parallel to the first linear path of movement.

11. The transport apparatus according to claim 7, wherein the transport apparatus has a sensor device for detecting a process disturbance caused by a missing workpiece or by a workpiece unsuitable for processing, and for signalling that disturbance to the support controller.

12. The transport apparatus according to claim 7, wherein the gripping tools are each assigned a gripping tool drive, which is arranged on the gripping tool support, for individual operation of the gripping tools, and a gripping tool controller which is configured to control the opening and closing movements and the clamping force of the individual gripping tools individually and to recognise a process disturbance caused by an empty gripping tool or by a workpiece incorrectly inserted into a gripping tool and to signal that disturbance to the support controller.

13. The method according to claim 2, wherein the process disturbance has been caused by a missing workpiece or by a workpiece incorrectly inserted into a gripping tool.

14. The method according to claim 2, wherein the process disturbance has been caused by a damaged part of a gripping tool or by a damaged part of the processing device.

15. The method according to claim 3, wherein the process disturbance has been caused by a damaged part of a gripping tool or by a damaged part of the processing device.

16. The transport apparatus according to claim 8, wherein the gripping tool support with the gripping tools is movable by the gripping tool support drive in a forward movement along a first linear path of movement and in a return movement along a second linear path of movement parallel to the first linear path of movement.

17. The transport apparatus according to claim 9, wherein the gripping tool support with the gripping tools is movable by the gripping tool support drive in a forward movement along a first linear path of movement and in a return movement along a second linear path of movement parallel to the first linear path of movement.

18. The transport apparatus according to claim 8, wherein the transport apparatus has a sensor device for detecting a process disturbance caused by a missing workpiece or by a workpiece unsuitable for processing, and for signalling that disturbance to the support controller.

19. The transport apparatus according to claim 9, wherein the transport apparatus has a sensor device for detecting a process disturbance caused by a missing workpiece or by a workpiece unsuitable for processing, and for signalling that disturbance to the support controller.

20. The transport apparatus according to claim 10, wherein the transport apparatus has a sensor device for detecting a process disturbance caused by a missing workpiece or by a workpiece unsuitable for processing, and for signalling that disturbance to the support controller.

* * * * *